US008314379B2

(12) United States Patent
Deilmann et al.

(10) Patent No.: US 8,314,379 B2
(45) Date of Patent: Nov. 20, 2012

(54) DRIVE UNIT FOR A SYNCHRONOUS ION SHIELD MASS SEPARATOR

(75) Inventors: Michael Deilmann, Essen (DE); Michael Gerding, Bochum (DE)

(73) Assignee: KROHNE Messtechnik GmbH, Duisburg (DE)

( * ) Notice: Subject to any disclaimer, the term of this patent is extended or adjusted under 35 U.S.C. 154(b) by 0 days.

(21) Appl. No.: 13/211,608

(22) Filed: Aug. 17, 2011

(65) Prior Publication Data

US 2012/0248302 A1 Oct. 4, 2012

(30) Foreign Application Priority Data

Mar. 30, 2011 (DE) ..... 10 2011 015 595

(51) Int. Cl.
*H01J 49/02* (2006.01)
*H01J 49/00* (2006.01)

(52) U.S. Cl. ..... 250/281; 250/282; 250/290

(58) Field of Classification Search ..... 250/281, 250/282, 287, 290, 292–294, 396 R
See application file for complete search history.

(56) References Cited

U.S. PATENT DOCUMENTS

| | | | | |
|---|---|---|---|---|
| 4,686,365 | A * | 8/1987 | Meek et al. | 250/281 |
| 5,354,988 | A * | 10/1994 | Jullien | 250/292 |
| 5,486,697 | A * | 1/1996 | Stalder et al. | 250/305 |
| 6,037,586 | A | 3/2000 | Baril | |
| 8,035,081 | B2 | 10/2011 | Sittler | |
| 8,134,120 | B2 * | 3/2012 | Mueller et al. | 250/281 |
| 2010/0090103 | A1 * | 4/2010 | Mueller et al. | 250/287 |
| 2011/0002109 | A1 * | 1/2011 | Hauschild et al. | 361/809 |
| 2011/0024616 | A1 * | 2/2011 | Pringle | 250/282 |

FOREIGN PATENT DOCUMENTS

| | | |
|---|---|---|
| GB | 2 392 304 A | 2/2004 |
| GB | 2 392 548 A | 3/2004 |
| WO | 2005/024381 A2 | 3/2005 |

OTHER PUBLICATIONS

Jan-Peter Hauschild, Scientist at the University of Hamburg-Harburg, The Novel Synchronous Ion Sheld Mass Analyzer, Journal of Mass Spectrometry, 2009, p. 44, English Statement of Relevancy Attached.

Eric Wapelhorst (Scientist at the University of Hamburg-Harburg) and Rheda-Wiedenbrück,Design and Production of a Planar Integrated Mikromassenspektrometers With Micro-Channel-Plate-Detector, 2010, English Statement of Relevancy Attached.

* cited by examiner

*Primary Examiner* — Bernard E Souw
(74) *Attorney, Agent, or Firm* — Robert Mlotkowski Safran & Cole, P.C.; David S. Safran

(57) ABSTRACT

A drive unit for a synchronous ion shield mass separator having a reference oscillator (1), a digital direct synthesizer (2), a low-pass filter (3) and a comparator (4), wherein the synchronous ion shield mass separator has a comb-shaped separation electrode (6), the reference oscillator (1) provides the direct digital synthesizer (2) with a reference frequency, the output signal generated by the direct digital synthesizer is filtered by the low-pass filter (3) and the output signal of the low-pass filter (3) is processed by the comparator (4). A drive unit that can be applied flexibly and economically is implemented in that the output signal of the comparator (4) is converted by a programmable element (11) into a number of output signals corresponding to the number of teeth (7) of the comb-shaped separation electrode (6).

16 Claims, 5 Drawing Sheets

DRIVE UNIT FOR A SYNCHRONOUS ION SHIELD MASS SEPARATOR

BACKGROUND OF THE INVENTION

1. Field of the Invention

The invention relates to a drive unit for a synchronous ion shield mass separator having a reference oscillator, a digital direct synthesizer, a low-pass filter and a comparator, wherein the synchronous ion shield mass separator has a comb-shaped separation electrode, the reference oscillator provides the direct digital synthesizer with a reference frequency, the output signal generated by the direct digital synthesizer is filtered by the low-pass filter and the output signal of the low-pass filter is processed by the comparator. The invention further relates to a method for driving a synchronous ion shield mass separator, wherein the synchronous ion shield mass separator has a comb-shaped separation electrode.

2. Description of Related Art

Mass separators of this type aid, in mass spectrometers, in separating charged particles—ions—according to mass or according to their mass/charge ratio and are thus also called analyzers. The mass separator makes up a substantial portion of the entire spatial requirements of the mass spectrometer. In the scope of miniaturizing mass spectrometers, it is thus of particular importance to develop a particularly small, yet still high-performance mass separator that further separates ions with extreme precision. Such a mass separator is described, for example, in the article "Mass spectra measured by a fully integrated MEMS mass spectrometer" by J.-P. Hauschild et al., International Journal of Mass Spectrometry, Elsevier, March 2007 and is called a synchronous ion shield mass separator there.

A synchronous ion shield mass separator consists essentially of a comb-shaped separation electrode. This comb-shaped separation electrode has a plurality of teeth, which are arranged next to one another at short distances on the comb ridge so that a small gap remains between the teeth of the separation electrode and the comb ridge. Often, the comb ridge also has small protrusions that are located opposite the teeth. The ions to be analyzed are charged with energy by an electrical field—as a function of their charge—and accelerated—as a function of their mass. After passing through the electrical field, the ions have an identical direction of movement. The electrical intensity of the field, on the one hand, and the mass and the charge of the ions, on the other hand, determine the speed of the ions after passing through the potential difference.

From one end of the gap, which is the entrance of the mass separator, the accelerated ions are placed parallel to the comb ridge in the mass separator. The mass separator is normally evacuated as far as possible, so that the ions can easily move along the gap. The requirements for the evacuation of a miniature mass separator are not as strict as that of a non-miniature mass separator, since the ions in a miniature mass separator only have to travel a very small distance and thus the possibility of impact with residual gas atoms or molecules is minimized.

By creating a voltage between one tooth and the comb ridge of the comb-shaped separation electrode, an electrical field is generated that diverts ions moving through the gap from their original direction of movement, so that they collide with the comb-shaped separation electrode and do not reach the other end of the gap, the exit of the mass separator. Depending on the charge of the ion and the direction of the electrical field, diverted ions collide either with the teeth or the comb ridge of the separation electrode. These diverted ions are no longer available for further analysis should, for example, the mass separator be inserted in a mass spectrometer.

It is known from the prior art to apply a voltage between every other tooth and the comb ridge and to apply no voltage between the teeth located between them and the comb ridge. In this way, a simple pattern of alternating applied voltage and non-applied voltage results along the teeth, called signal sequence in the following. A simplified representation of such a signal sequence occurs here with zeros and ones, wherein a one represents the presence of an electrical potential difference and a zero represents the absence of an electrical potential difference. The signal sequence described above of alternating applied voltage and non-applied voltage thus corresponds to a signal sequence of alternating zeros and ones. In a comb-shaped separation electrode having 10 teeth, the result of strictly alternating presence and absence of a potential difference is:

0101010101

In order to obtain a separation of ions according to mass according to the prior art, the signal sequence is shifted by one tooth in the direction of the exits of the separation electrode with a certain cycle frequency. I.e., the following signal sequence results in the next cycle step for the above-described comb-shaped separation electrode with 10 teeth:

1010101010

Only ions with a certain velocity given by the cycle frequency and the geometry of the separation electrode follow the erratic zeros of the signal sequence, i.e., the areas without a field in the separation electrode, and reach the exit of the mass separator. While moving in the gap of the separation electrode, ions with a velocity that is too high or too low arrive in areas, in which they are deflected by an electric field present between a tooth and the comb ridge. As a result, only ions having a certain mass to charge ratio are let through by the mass separator, i.e., are separated from ions having another mass to charge ratio. By changing the cycle frequency, other ion velocities and, consequently, other mass to charge ratios can be selected by the mass separator. Although the mass separator does not select according to mass, but to mass to charge ratio, it is common to speak of a mass separator.

A mass separator known from the prior art is normally driven in that the output signal of the comparator of a mass separator as described in the introduction is split into two signals and one of these signals is inverted. As a result, two complementary signals switching at the same cycle frequency are obtained. These two signals are, in turn, used for driving the teeth of the separation electrode, wherein one of the signals controls the first and every other further tooth–i.e., the uneven-numbered teeth—of the separation electrode and the other of the two signals controls the second and every other further tooth—i.e., the even-numbered teeth—of the separation electrode.

Furthermore, a method is known from the article "The novel synchronous ion shield mass analyzer" by J.-P. Hauschild et al., Journal of Mass Spectrometry, 2009, 44, in which the resolution of a synchronous ion shield mass separator is increased in that the turn-on times of the voltage on the teeth of the separation electrode are increased in relation to the turn-off times. A drive switch for implementing this method is described in "Optimierung der Ansteuerung des SIS-Massenseparators im planar integrierten Micro-Massenspektrometer" ("Optimizing the Drive of the SIS Mass Separator in a Planar Integrated Mass Spectrometer") by G. Quiring et al., Mikrosystemtechnik Kongress, 2009, VDE Verlag GmbH. This drive switch encompasses essentially four parallel signal paths, each of which has a direct digital synthesizer, a low-pass filter and a comparator. Due to the different designs of the signal paths, this drive switch is technically elaborate and costly. Furthermore, the possible signal sequences are very limited.

SUMMARY OF THE INVENTION

Thus, a primary object of the invention is to provide a drive unit and a method for driving a synchronous ion shield mass separator that can be flexibly used and is economical.

The above object is met in that a drive unit of the type described in the introduction has the output signal of the comparator converted by a programmable element into a number of output signals corresponding to the number of teeth of the comb-shaped separation electrode. When using appropriate programming and driving of the programmable element, the use of a programmable element allows for the issue of output signals, which basically correspond to an arbitrary signal sequence. For this reason, not only the signal sequence known from the prior art, but also, even regardless of hardware, user-defined signal sequences can be used by the drive unit according to the invention. In order to create another signal sequence with the same hardware, it is sufficient to change the programming of the programmable element. Furthermore, the drive unit according to the invention is considerably simpler in terms of construction than the drive unit from the prior art, so that there is a substantial cost advantage in this case.

According to an advantageous design of the invention, it is provided that the programmable element is a programmable logic element in the form of a FPGA. A further advantageous design of the invention is wherein the programmable logic element is a CPLD. Here, FPGA is a so-called field programmable gate array, which represents a programmable integrated circuit. The complex programmable logic device, abbreviated CPLD, is also a programmable integrated circuit. FPGAs and CPLDs are widespread and thus economical microchips for implementing specific programs. Depending on the requirements of the signal sequence, the use of a FPGA or a CPLD occurs after weighing the advantages and disadvantages of the possible FPGAs and CPLDs.

Alternatively, a microcontroller can be used as a programmable element, though it is necessary to determine whether or not the requirements can be fulfilled for the signal sequence to be precisely switched in terms of time by the microcontroller and the operating system implemented there. Preferably, a digital signal processor having an operating system with real-time characteristics can be use for the present application.

The above described object is also met based on the method for driving a synchronous ion shield mass separator as described in the introduction that has been improved by the output signal of a drive unit according to the invention being used to drive the teeth of the comb-shaped separation electrode according to the above design. A particularly flexible possibility for driving a synchronous ion shield mass separator can be implemented with the method according to the invention with the drive unit as already described, since the signal sequence that can be created with the drive unit is basically arbitrary—this with a particularly simple and economical construction of the drive unit. Not every signal sequence is suitable for driving a synchronous ion shield separator. For example, a signal sequence that consists only of ones leads to the ions not being able to pass through the mass separator. A selection of particularly advantageous signal sequences is described in the following.

According to an advantageous further development of the invention, it is provided that the output signals of the driving unit have a signal sequence in which the signal sequence consists of alternating series n zeros and m ones, wherein all k cycles of the programmable element bring the signal sequence forward j steps, wherein n, m, k and j are natural numbers larger than zero and wherein n is greater than or equal to the ratio (j mod (n+m))/k. The latter requirement, that n is greater than or equal to the ratio (j mod(n+m))/k is of significant importance for such a signal frequency. Here, j mod(n+m) indicates the result of the division of j by (n+m). Foremost, this requirement guarantees that ions are even able to pass through the mass separator. This becomes particularly clear using a simple example.

For example, if n is equal to 1, m equal to 2, k equal to 1 and j equal to 2, this means that the area without a field, which is represented by zeros and in which no diversion of the ion occurs, is exactly one tooth wide. If this tooth moves exactly two teeth further at each cycle, this means that ions do not have the possibility of moving from one area without a field of a cycle to the next area without a field of the next cycle, since there is always an area that continually has an electrical field between an area without a field in one cycle and an area without a field in the next cycle. This can be seen as follows in a comb-shaped separation electrode with 10 teeth (bold represents the position that always has an electrical field):

1. Cycle: 0110110110

2. Cycle: 1101101101

In this example, and all following examples, it is assumed that the ions are introduced into the mass separator from the left side, i.e., in the first cycle initially reaches a tooth without a field, this corresponds to the first numeral 0 in the signal sequence of the first cycle shown above. In the second cycle, these ions do not have the possibility of reaching the next tooth without a field, since the continuous electrical field blocks the path to the next tooth without a field, which is represented by the third numeral—0—of the signal sequence of the second cycle.

An advantageous design of the invention is wherein the number n is equal to 2, the number m is equal to 2, the number k is equal to 1 and the number j is equal to 2. The first two cycles of the signal sequence are repeated in further cycles and result, for example, in the following for a comb-shaped separation electrode with 10 teeth:

1. Cycle: 0011001100

2. Cycle: 1100110011

According to a particularly advantageous further development of the invention, it is provided that the number 11 is equal to 2, the number m is equal to 2, the number k is equal to 1 and the number j is equal to 1. The first four cycles of this signal sequence are repeated in further cycles and result, for example, in the following for a comb-shaped separation electrode with 10 teeth:

1. Cycle: 0011001100

2. Cycle: 1001100110

3. Cycle: 1100110011

4. Cycle: 0110011001

In a further preferred design of the invention, it is provided that the number n is equal to 1, the number m is equal to 1, the number k is equal to 1 and the number j is equal to 1. This design according to the invention corresponds exactly to the signal sequence known from the prior art consisting of alternating ones and zeros, which moves one step further at each cycle. The first two cycles of this signal sequence are repeated in further cycles and result, for example, in the following for a comb-shaped separation electrode with 10 teeth:

1. Cycle: 0101010101

2. Cycle: 1010101010

According to a further preferred design of the invention, it is provided that the number m is greater than the number n. Here, it is of particular advantage when the number n is equal to 3 and the number m is equal to 5.

It is further provided in a preferred design that the output signals of the drive unit have a signal sequence, in which the signal sequence consists of e zeros followed by ones, wherein the signal sequence moves h steps further every g cycles of the programmable element, wherein e, g and h are natural number greater than zero and wherein e is greater or equal to the ratio h/g. The latter requirement, that e is greater of equal to the ratio h/g is of significance for such a signal sequence. Here, too, the requirement guarantees that ions can even pass through the mass separator. The signal sequence consists namely only of one single block of e zeros and otherwise only of ones, i.e., only one "package" of ions, namely in the block of e zeros, which represents an area without a field of e teeth, is accepted by the mass separator and only the ions of the package having a certain velocity and thus a certain mass to charge ratio can pass through the mass separator.

If the requirement that e is greater than or equal to the ratio hlg is not fulfilled, this means that the ions do not have the possibility of moving from the block without a field of a first cycle into the next block without a field of the following cycle, since there is always an area that has a continuous electrical field between a block without a field in one cycle and a block without a field in the next cycle.

In a particularly advantageous design of the invention, it is provided that the number e is equal to 1, the number g is equal to 1 and the number h is equal to 1. This corresponds to a signal sequence in which one, single zero moves along the teeth of the separation electrode. In a comb-shaped separation electrode with 5 teeth, the following signal sequence results:

1. Cycle: 01111

2. Cycle: 10111

3. Cycle: 11011

4. Cycle: 11101

5. Cycle: 11110

6. and all further cycles: 11111

According to a further advantageous design of the invention, it is provided that the signal sequence is implemented by a shift register. The shift register is implemented in the programmable element. The sequence of zeros and ones stored in the storage element of the shift register moves a given number of steps further at each cycle. Values at the end of the shift register are lead back again to the beginning of the shift register. The values of the storage element of the shift register together form the output signals of the programmable element.

In a particularly advantageous design of the invention, it is provided that the signal sequence is uploaded from storage at each cycle of the element for which a change of the output signal is planned. Instead of a shift register, it is possible to provide storage in the programmable element, in which the signal sequence to be used for each cycle is stored. This signal sequence is uploaded for each cycle from the storage and issued at the exits of the programmable element.

In detail, there are a number of possibilities for designing and further developing the drive unit according to the invention as will become apparent from the following detailed description of preferred embodiments of the invention in conjunction with accompanying drawings.

DETAILED DESCRIPTION OF THE INVENTION

Figure 1:
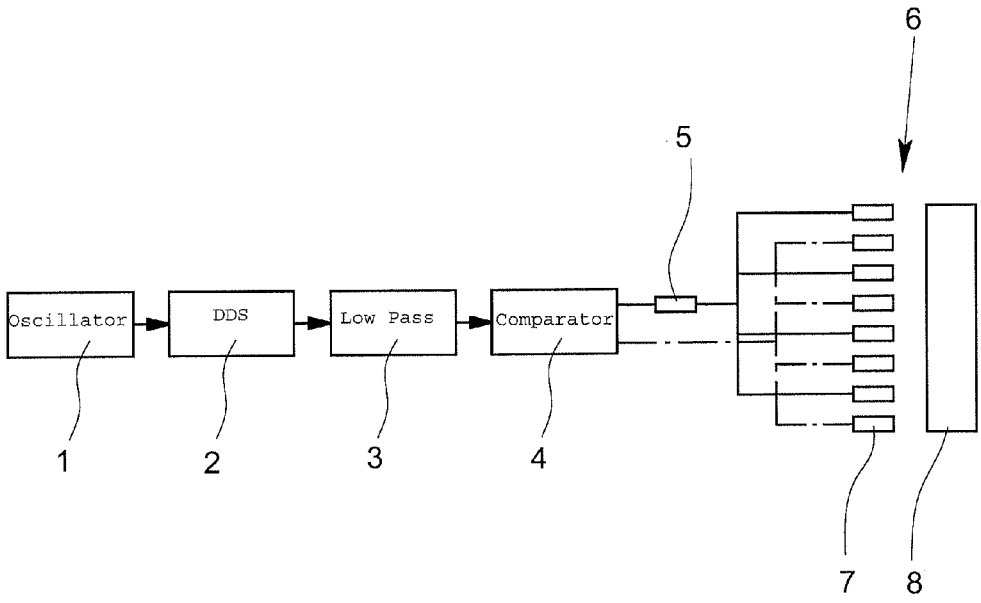
Fig. 1 (Prior Art)
FIG. 1 a schematic drive unit known from the prior art.

The drive unit known from the prior art shown in FIG. 1 has a reference oscillator 1 for creating a reference frequency signal. The reference frequency signal of the reference oscillator 1 is converted from a direct digital synthesizer 2 into a given frequency. After low-pass filtering of the frequency signal of the direct digital synthesizer 2 by a low-pass filter 3, the frequency signal now free of unwanted frequency portions is processed by a comparator 4. The comparator 4 issues two identical output signals, of which one is inverted by an inverter 5. The inverted and the non-inverted signal aid in driving a comb-shaped separation electrode 6. The separation electrode 6 has a plurality of teeth 7 on a comb ridge 8. The non-inverted signal aids in driving the first and every other further tooth 7 of the separation electrode 6. The inverted signal aids in driving the second and every other further tooth 7 of the separation electrode 6.

Figure 2:
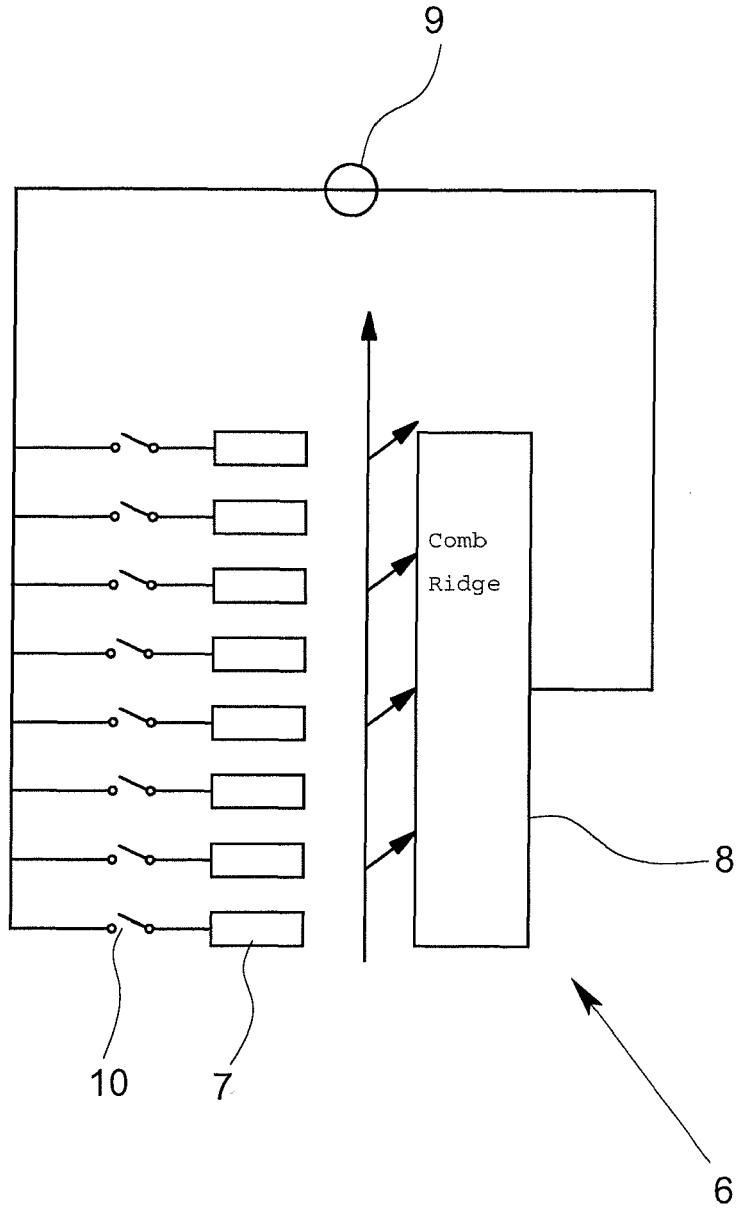
Fig. 2 (Prior Art)
FIG. 2 a schematic function of a synchronous ion shield mass separator known from the prior art, FIG. 3 a schematic drive unit according to the invention, FIG. 4 a schematic function of the method according to the invention using a shift register, and FIG. 5 a schematic representation of afunction of the method according to the invention using a storage.

The more exact function of the separation electrode 6 shown in FIG. 1 can be seen in FIG. 2. The comb ridge 8 of the separation electrode 6 is joined to the teeth 7 of the separation electrode 6 via a voltage source 9 and multiple switches 10. Here, each tooth 7 is assigned to one switch 10. If all switches 10 are open, ions moving parallel to the comb ridge 8 can move forward without hindrance between the comb ridge 8 and the teeth 7. If one of the switches 10 is closed, a voltage given by the voltage source 9 exists between the corresponding teeth 7 and the comb ridge 8. The electrical field resulting from this voltage between the corresponding teeth 7 and the comb ridge 8 is capable of diverting ions moving parallel to the comb ridge 8 between the comb ridge 8 and the teeth 7. Normally, these ions collide with the structures of the separation electrode 6 and are not available for further analysis.

The switches 10 assigned to the teeth 7 of the separation electrode 6 are, as can be seen in FIG. 1, driven by the inverted and the non-inverted signals of the comparator 4. Thus, there is a voltage on every other tooth 7 and no voltage on the rest of the teeth 7. This signal sequence of alternating applied voltage and non-applied voltage on the teeth is inverted with the frequency given by the direct digital synthesizer 2. This is synonymous with the signal sequence applied to the teeth 7 moving one step further in the direction of the exit of the separation electrode 6 with each cycle of the frequency of the direct digital synthesizer 2.

In FIG. 2, the exit is arranged at the upper end of the separation electrode, as can be taken from the marked arrows, the possible paths of the ions to be analyzed are described as an example. Ions that have the same velocity as the signal sequence moving along the teeth 7 can, when there is no voltage on the first tooth when entering the separation electrode 6, i.e., they initially encounter a zero in the signal sequence, follow this area without a field represented by a zero through the separation electrode 6, and thus, reach the exit of the separation electrode 6. Ions having a lower or higher velocity than that of the signal sequence encounter an area within the separation electrode 6, in which they are diverted by a field, which is caused by voltage applied to the teeth 7 in this area and do not reach the exit of the separation electrode 6. A possibility not shown here for driving the teeth 7 comprises applying each of the inverted signal originating from the comparator 4 and the non-inverted signal directly to the teeth 7 after possible strengthening of the voltage signal. In this embodiment, the voltage source 9 and the switch 10 are not necessary.

Figure 3:
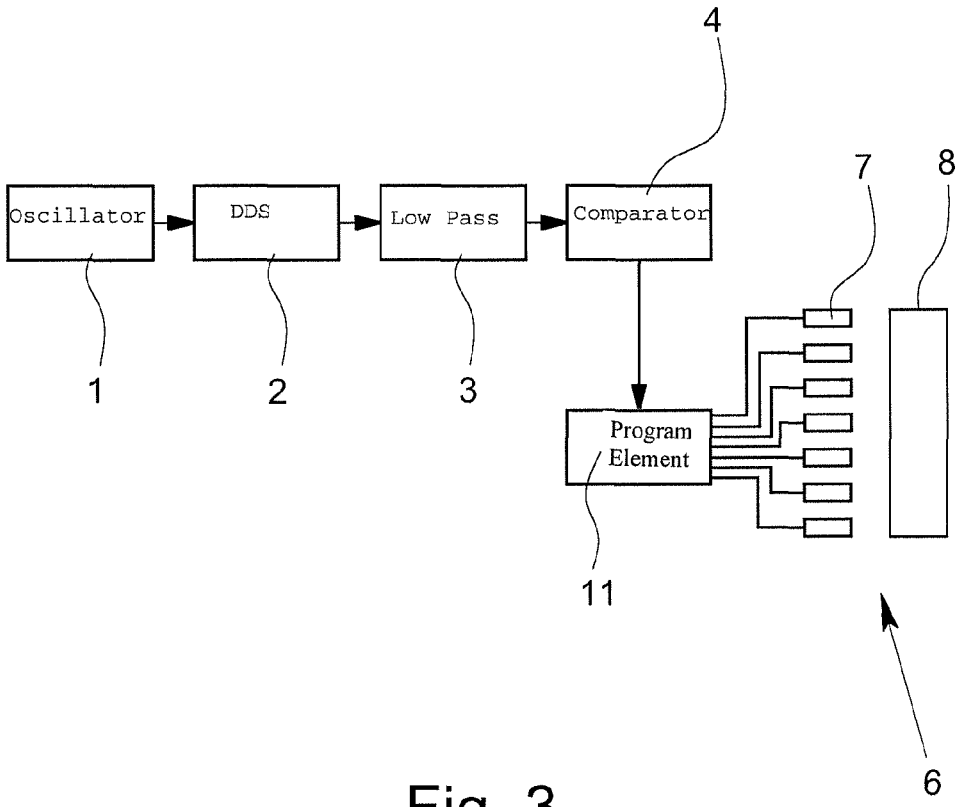

The function of the drive unit according to the invention can be seen in FIG. 3. Similar to the drive unit known from the prior art of FIG. 1, the drive unit according to the invention also has a reference oscillator 1, a direct digital synthesizer 2, a low-pass filter 3 and a comparator 4 that are switched in the same manner as in FIG. 1. The comparator 4 of the drive unit according to the invention, however, only issues a, single output signal, which is led to a programmable element 11. The programmable element 11 has a number of output signals corresponding to the number of teeth 7 of the comb-shape separation electrode 6. This means that each tooth 7 of the separation electrode 6 is assigned to one output signal of the programmable element 11, and thus, each tooth 7 can be individually driven via the corresponding output signal of the programmable element 11.

Figure 4:
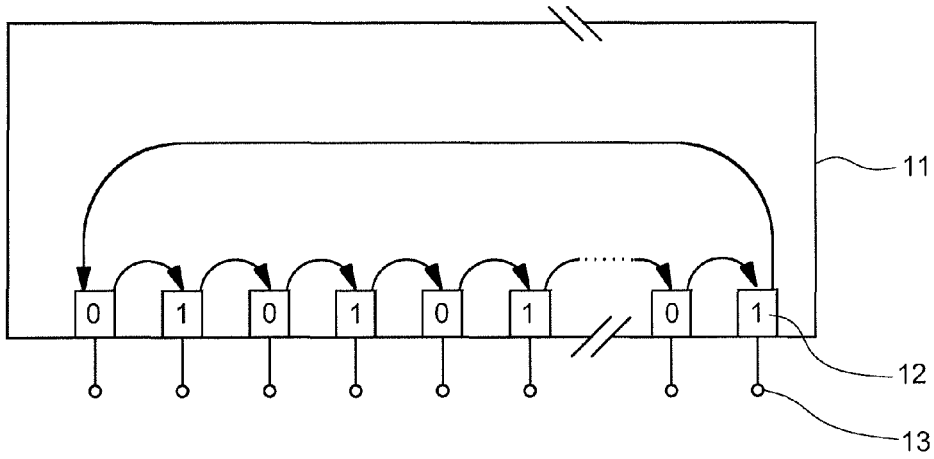

FIG. 4 shows a programmable element in which the method according to the invention is implemented by a shift register. The shift register within the programmable element 11 has a number of storage elements 12 corresponding to the exits 13 of the programmable element 11, here. The desired signal sequence is saved in the storage elements 12 of the programmable element 11. In the present case, this is a simple sequence of alternating zeros and ones. At each cycle of the programmable element 11 for which a change in the output signal is planned, the value saved in each storage element 12 of the shift register is given further to the next storage element 12 of the shift register. The value saved in the last storage element 12 of the shift register is then given further to the first storage element 12 of the shift register.

Figure 5:
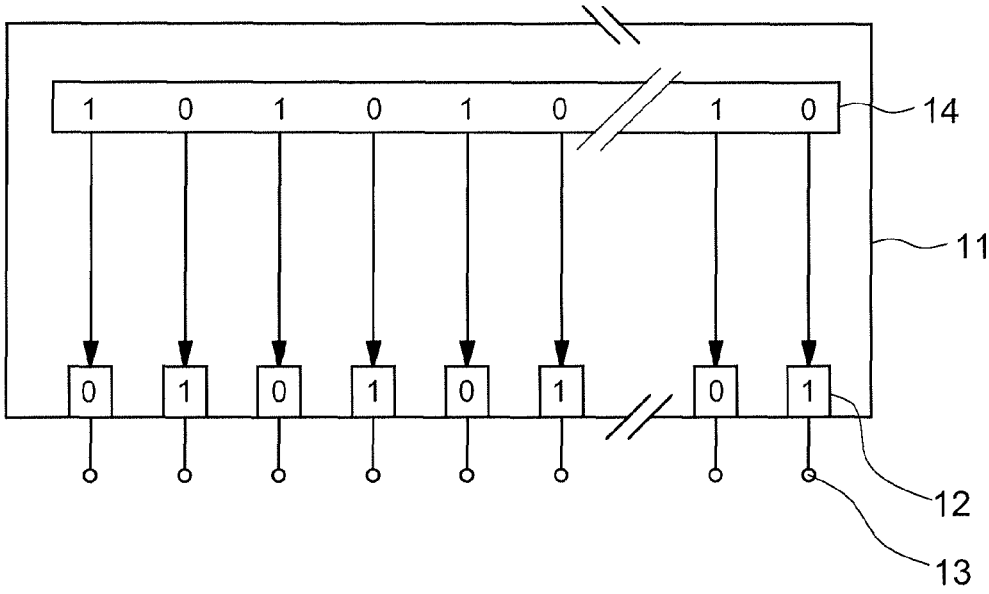

FIG. 5 shows a programmable storage element 11 that has storage 14. The signal sequences to be issued by the programmable element 11 are stored in the storage 14. At each cycle of the programmable element, in which a change in the output signal is planned, a signal sequence is uploaded from the storage 14 and issued via the storage element 12 and the exits 13. In this manner, nearly any signal sequence can be issued by the programmable element 11. In the present example, a simple signal sequence of alternating zeros and ones is shown which can, for example, be any of the sequences described in the Summary portion of this specification.

What is claimed is:

1. Drive unit for a synchronous ion shield mass separator comprising:

a reference oscillator, a digital direct synthesizer connected to the reference oscillator for receiving a reference frequency therefrom, a low-pass filter connected to the digital direct synthesizer to filter an output signal generated by the direct digital synthesizer, and a comparator connected to the low-pass filter to process an output signal of the low-pass filter, and a comb-shaped separation electrode, wherein a programmable element is provided which is adapted for converting an output signal of the comparator into a number of output signals corresponding to the number of teeth of the comb-shaped separation electrode.

2. Drive unit according to claim 1, wherein the programmable element is a programmable logic element.

3. Drive unit according to claim 2, wherein the programmable logic element is a field programmable gate array (FPGA).

4. Drive unit according to claim 2, wherein the programmable logic element is a complex programmable logic device (CPLD).

5. Drive unit according to claim 2, wherein the programmable logic element is a microcontroller in the form of a digital signal processor (DSP).

6. Method for driving a synchronous ion shield mass separator having a comb-shaped separation electrode comprising the steps of:

providing a reference frequency to a digital direct synthesizer, using a low-pass filter to filter an output signal generated by the direct digital synthesizer, using a comparator connected to process an output signal of the low-pass filter, and using a programmable element to convert an output signal of the comparator into a number of output signals corresponding to the number of teeth of a comb-shaped separation electrode to the drive teeth of the comb-shaped separation electrode.

7. Method for driving a synchronous ion shield mass separator according to claim 6, wherein the output signals of the programmable element have a signal sequence comprising an alternating sequence of n zeros and m ones, wherein all k cycles of the programmable element bring the signal sequence forward j steps, wherein n, m, k and j are natural numbers larger than zero and wherein n is greater than or equal to the ratio (j mod(n+m))/k.

8. Method for driving a synchronous ion shield mass separator according to claim 7, wherein the number n is equal to 2, the number m is equal to 2, the number k is equal to 1 and the number j is equal to 2.

9. Method for driving a synchronous ion shield mass separator according to claim 7, wherein the number n is equal to 2, the number m is equal to 2, the number k is equal to 1 and the number j is equal to 1.

10. Method for driving a synchronous ion shield mass separator according to claim 7, wherein the number n is equal to 1, the number m is equal to 1, the number k is equal to 1 and the number j is equal to 1.

11. Method for driving a synchronous ion shield mass separator according to claim 7, wherein the number m is greater than the number n.

12. Method for driving a synchronous ion shield mass separator according to claim 11, wherein the number n is equal to 3 and the number m is equal to 5.

13. Method for driving a synchronous ion shield mass separator according to claim 6, wherein the output signals of the programmable element have a signal sequence comprised of e zeros followed by ones, wherein all g cycles of the programmable element bring the signal sequence forward h steps, wherein e, g, and h are natural numbers greater than zero and wherein e is greater than or equal to the ratio h/g.

14. Method for driving a synchronous ion shield mass separator according to claim 13, wherein the number e is equal to 1, the number g is equal to 1 and the number h is equal to 1.

15. Method for driving a synchronous ion shield mass separator according to claim 7, wherein a signal frequency is implemented by a shift register.

16. Method for driving a synchronous ion shield mass separator according to claim 7, wherein a signal frequency is uploaded from a storage at each cycle of the programmable element for which a change of the output signal is provided.

* * * * *